US008020971B2

(12) United States Patent
Kubo et al.

(10) Patent No.: US 8,020,971 B2
(45) Date of Patent: Sep. 20, 2011

(54) LIQUID EJECTION HEAD, LIQUID EJECTION APPARATUS AND LIQUID EJECTION METHOD

(75) Inventors: Naomi Kubo, Hachioji (JP); Yasuo Nishi, Hachioji (JP); Atsuro Yanata, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 455 days.

(21) Appl. No.: 12/224,049

(22) PCT Filed: Feb. 15, 2007

(86) PCT No.: PCT/JP2007/052704

§ 371 (c)(1),
(2), (4) Date: Aug. 15, 2008

(87) PCT Pub. No.: WO2007/099774

PCT Pub. Date: Sep. 7, 2007

(65) Prior Publication Data

US 2009/0096837 A1 Apr. 16, 2009

(30) Foreign Application Priority Data

Feb. 28, 2006 (JP) ..... 2006-052399

(51) Int. Cl.
*B41J 2/06* (2006.01)
*B41J 2/12* (2006.01)
*B41J 2/115* (2006.01)

(52) U.S. Cl. ..... 347/55; 347/79; 347/80

(58) Field of Classification Search ..... 347/55, 347/76, 77, 79, 80, 82
See application file for complete search history.

(56) References Cited

U.S. PATENT DOCUMENTS 4,059,480 A * 11/1977 Ruh et al. ..... 438/701
6,017,112 A * 1/2000 Anderson et al. ..... 347/40

FOREIGN PATENT DOCUMENTS

| | | | |
|---|---|---|---|
| JP | 05-104725 | A | 4/1993 |
| JP | 05-278212 | A | 10/1993 |
| JP | 06-134992 | A | 5/1994 |
| JP | 10-166592 | A | 6/1998 |
| JP | 2003-053977 | A | 2/2003 |
| JP | 2005-186290 | * | 7/2005 |
| WO | WO 03/070381 | A1 | 8/2003 |
| WO | WO 2006/067966 | A1 | 6/2006 |
| WO | WO 2006/068036 | A1 | 6/2006 |

OTHER PUBLICATIONS

U.S. Appl. No. 12/224,048, filed Aug. 15, 2008, Confirmation No. 4098.

* cited by examiner

*Primary Examiner* — Geoffrey Mruk
(74) *Attorney, Agent, or Firm* — Holtz, Holtz, Goodman & Chick, PC

(57) ABSTRACT

A liquid ejection head, having: an insulating nozzle plate provided with a nozzle having, a liquid supply port to supply liquid and an ejection port to eject the liquid supplied from the liquid supply port onto a substrate; a cavity communicating with the liquid supply port to reserve the liquid to be ejected from the ejection port; an electrostatic voltage applying device to generate an electrostatic attraction force by applying an electrostatic voltage between the liquid in the nozzle and the cavity, and the substrate; and a control device to control the electrostatic voltage applying device for conducting polarization relaxation operation by applying an electrostatic voltage having reverse polarity opposite to that of the electrostatic voltage applied in liquid ejection, wherein the nozzle is a flat nozzle and the control device.

10 Claims, 8 Drawing Sheets

LIQUID EJECTION HEAD, LIQUID EJECTION APPARATUS AND LIQUID EJECTION METHOD

This application is the United States national phase application of International Application PCT/JP2007/052704 filed Feb. 15, 2007.

TECHNICAL FIELD PERTAINING TO THE INVENTION

The present invention relates to a liquid ejection head, liquid ejection apparatus and liquid ejection method, and in particular, to a liquid ejection head, a liquid ejection apparatus, and a liquid ejection method having a flat nozzle.

PRIOR ART

As a technology to eject high viscosity liquid besides low viscosity liquid from a micro nozzle of a liquid ejection head, there has been known a liquid ejection technology using an electrostatic attraction method wherein liquid in the nozzle is charged and ejected by an electrostatic attraction force excited by an electric filed created between the nozzle and various kinds of substrates representing an object on which liquid droplets land (International Publication No. 03/070381 Pamphlet)

Also, development of an electric field assist method where the above liquid ejection technology and a liquid ejection technology using a pressure created by forming of bubbles inside the liquid or by distortion of a piezoelectric element are combined is being promoted (Unexamined Japanese Patent Application Publication Nos. H5-104725, H5-278212, H6-134992, H10-166592 and 2003-53977). In the Patent Document H10-166592, there is disclosed a liquid ejection head to eject the liquid where the electrostatic voltage is synchronized with printing pulse of the piezoelectric element. Such electric field assist method is an ejection method where a liquid meniscus is raised at an ejection port of the nozzle using a meniscus forming device and the electrostatic attraction force imposed on the meniscus is enhanced to make the meniscus to be a liquid droplet against a surface tension of the liquid.

It is known that using a nozzle plate of high resistance material having a volume resistance of $10^{15}$ Ωm or more for the above liquid ejection head of electrostatic attraction method or electric field assist method, even for a flat shape without the ejection port being protruded, the electric field is created between the head and a counter electrode by applying electrostatic voltage onto the liquid in the nozzle, thereby a meniscus of the liquid is formed at the ejection port of the nozzle, then an intensive concentration of the electric field occurs at the meniscus, thus the meniscus is transformed into a liquid droplet and ejected by the electrostatic attraction force caused by the concentrated electric field (International Publication No. 06/067966 Pamphlet).

Further, it is known that by combining a meniscus generating device using a pressure generating device (piezoelectric element), the electrostatic voltage to be applied can be lowered (International Publication No. 06/068036 Pamphlet).

Patent Document 1: International Publication No. 03/070381 Pamphlet

Patent Document 2: Unexamined Japanese Patent Application Publication No. H5-104725

Patent Document 3: H5-278212

Patent Document 4: H6-134992

Patent Document 5: H10-166592

Patent Document 6: 2003-53977

Patent Document 7: International Publication No. 06/067966 Pamphlet

Patent Document 8: International Publication No. 06/068036 Pamphlet

DISCLOSURE OF THE INVENTION

Problems to be Solved by the Present Invention

However, there was found a problem that though the nozzle plate of high resistance material or the meniscus forming device is combined with the liquid ejection head of the electrostatic attraction method or the electric field assist method described in Patent Documents 1 to 6, ejection of the liquid droplet becomes inconsistent or ejection of liquid ceases if the electrostatic voltage is applied continuously for a long time.

The phenomenon is that the concentrated electric field intensity at front end of the meniscus decreases due to space-charge polarization of the nozzle plate and ejection of liquid becomes impossible. In this case, liquid cannot be ejected again unless space-charge polarization of the nozzle plate is resolved and the nozzle plate is brought back to an initial condition. However, there was a problem that it is time consuming to resolve space-charge polarization thus ejection operation cannot be performed in the meantime, therefore productivity is deteriorated if such liquid ejection head is used for industrial application.

Therefore, an object of the present invention is to provide a liquid ejection head, liquid ejection apparatus and liquid ejection method to realize continuous ejection operation by recovering the polarization state of the nozzle plate readily in a short time.

Means to Solve the Problems (1) To solve the above problems, a configuration of item 1 is a liquid ejection head comprising:

an insulating nozzle plate provided with a nozzle having, a liquid supplying port to supply liquid and an ejection port to eject the liquid supplied from the liquid supplying port onto a substrate;

a cavity communicating with the liquid supplying port to reserve the liquid to be ejected from the ejection port;

an electrostatic voltage applying device to generate an electrostatic attractive force by applying an electrostatic voltage between the liquid in the nozzle and the cavity, and the substrate; and a control device to control application of the electrostatic voltage by the electrostatic voltage applying device, wherein the nozzle is a float nozzle not protruding from the nozzle plate and the control device controls the electrostatic voltage applying device in a way that the electrostatic voltage applying device conducts polarization relaxation operation to apply an electrostatic voltage having reverse polarity opposite to that of the electrostatic voltage applied in liquid ejection.

According to the configuration of item 1, when ejection of the liquid becomes impossible after liquid ejection operation is continued for a long time by applying an electrostatic voltage having the same polarity between the counter electrode and the flat nozzle plate having isolation properties, polarization of the nozzle plate can be recovered by applying an electrostatic voltage having reverse polarity to the electrostatic voltage applied at liquid ejection. Thereby, the nozzle plate can be recovered readily in a short time, compare to just waiting recovery of polarization of the nozzle plate by simple ceasing application of the electrostatic voltage. Therefore, in case the liquid ejection head is used for a production line, ejection operation can be continued without deteriorating the productivity due to defective ejection of liquid.

(2) A configuration of item 2 is the liquid ejection head of item 1, further comprising:

a memory device to store an application time of the electrostatic voltage and an electrostatic voltage application vale applied by the electrostatic voltage applying device in liquid ejection, wherein based on the application time and the electrostatic voltage application value, the control device determines the electrostatic voltage value having reverse polarity so that an integrated value of the electrostatic voltage applied in liquid ejection integrated with respect to the application time and an integrated value of the electrostatic voltage having reverse polarity with respect to the application time equate in an absolute value, and causes the electrostatic voltage applying device to conduct polarization relaxation operation using the electrostatic voltage value thereof.

According to the configuration of item 2, polarization of the nozzle plate can be recovered by applying a reverse voltage so that the integrated values of the electrostatic voltage values applied in the polarization relaxation operation and in liquid ejection with respect to the application time equate. Therefore, for example, if the polarization relaxation operation time is desired to be shortened, polarization of the nozzle plate caused by applying the electrostatic voltage in liquid ejection can be recovered by increasing the electrostatic voltage value.

(3) The configuration of item 3 is the liquid ejection head of item 1 or 2, further comprising a pressure generating device to form a meniscus projecting towards an ejection direction of the liquid at the ejection port by generating a pressure in the liquid by changing a volume of the cavity.

According to the configuration of item 3, by forming the meniscus through the pressure generating device, the electrostatic voltage required for ejecting the liquid droplet can be reduced. Also, control of liquid ejection operation can be conducted by driving the pressure generation device which only raises the meniscus but not by the electrostatic voltage having a high voltage.

(4) The configuration of item 4 is the liquid ejection head of any one of items 1 to 3, wherein a volume resistance of the nozzle plate is not less than $10^{15}$ Ωm.

According to the configuration of item 4, a strong electric field can be created at front end of the meniscus with a nozzle plate having a volume resistance of not less than $10^{15}$ Ωm, and the liquid droplet can be ejected consistently and efficiently.

(5) The configuration of item 5 is the liquid ejection head of any one of items 1 or 4, wherein an inside diameter of the ejection port is not more than 15 μm.

According to the configuration of item 5, by making the inside diameter of the liquid ejection port to be less than 15 μm, the electric field is efficiently concentrated at the front end of the meniscus, thereby the liquid droplet can be ejected consistently and efficiently.

(6) The configuration of items 6 is a liquid ejection apparatus, having the liquid ejection head of any one of items 1 to 5 and a counter electrode facing the liquid ejection head, wherein the liquid is ejected by an electrostatic attractive force created between the liquid ejection head and the counter electrode.

According to the configuration of item 6, the same effects as in the items 1 to 5 can be obtained in the liquid ejection apparatus.

(7) The configuration of item 7 is a liquid ejection apparatus having the liquid ejection head of item 1 and a counter electrode facing the liquid ejection head to eject the liquid by an electrostatic attractive force created between the liquid ejection head and the counter electrode, and further having a positioning device to narrow a dividing distance between the liquid ejection head and the counter electrode by adjusting the positions thereof during polarization relaxation operation.

According to the configuration of item 7, when the electrostatic voltage having the reverse polarity is applied, the electrostatic voltage value having a reverse polarity used for polarization recovery can be suppressed by narrowing the dividing distance between the liquid ejection head and the counter electrode (8) A configuration of item 8 is a liquid ejection method, comprising:

using a liquid ejection head having;

an insulation nozzle plate provided with a nozzle having, a liquid supplying port to supply liquid and an ejection port to eject the liquid supplied from the liquid supplying port onto a substrate;

a cavity communicating with the liquid supplying port to reserve the liquid to be ejected from the ejection port;

an electrostatic voltage applying device to generate an electrostatic attractive force by applying an electrostatic voltage between the liquid in the nozzle and the cavity, and the substrate; and a control device to control application of the electrostatic voltage by the electrostatic voltage applying device, and controlling the electrostatic voltage applying device to conduct polarization relaxation operation in which the electrostatic voltage having the reverse polarity opposite to that of the electrostatic voltage applied in liquid ejection is applied, wherein the nozzle is a flat nozzle not protruding form the nozzle plate.

According to the configuration of the item 8, polarization of the nozzle plate can be recovered by applying the electrostatic voltage having the reverse polarity to that of the electrostatic voltage applied in liquid ejection. when liquid ejection operation is continued for a long time by applying the electrostatic voltage having the same polarity between the insulating flat nozzle plate and the counter electrode, the electric field intensity reduces due to polarization of the nozzle plate and ejection of liquid becomes impossible. Thereby, polarization of the nozzle plate can be recovered readily in a short time, compare to just waiting recovery of polarization of the nozzle plate by simple ceasing application of electrostatic voltage. Therefore, in case the liquid ejection head is used for a production line, ejection operation can be continued without deteriorating the productivity due to defective ejection of liquid.

(9) The configuration of item 9 is the liquid ejection method of item 8, comprising: using a memory device to store an application time of the electrostatic voltage and an electrostatic voltage application value applied by the electrostatic voltage applying device in liquid ejection;

determining the value of the electrostatic voltage having opposite polarity based on the application time and the electrostatic voltage application value, so that an integrated value of the electrostatic voltage applied in liquid ejection with respect to the application time and an integrated value of the electrostatic voltage having opposite polarity with respect to the application time equate in an absolute value; and causing the electrostatic voltage applying device to conduct polarization relaxation operation using the electrostatic voltage value thereof.

According to the configuration of item 9, polarization of the nozzle plate can be recovered by applying opposite voltage in a way that the integrated value of the electrostatic voltage in recovery operation with respect to the application time agrees to that in liquid ejection. Thereby, for example, if the polarization time has to be shortened, by increasing the electrostatic voltage, polarization of the nozzle plate caused by applying electrostatic voltage in liquid ejection can be recovered.

(10) The configuration of item 10 is the liquid ejection method of item (8) or (9), comprising:

generating a pressure in the liquid by changing a volume of the cavity; and ejecting the liquid using the pressure generating device to form a meniscus projecting towards a liquid ejection direction at the ejection port.

According to the configuration of item 10, the electro static voltage required for ejecting the liquid droplet can be reduced by forming the meniscus with the pressure generating device. Also, liquid ejection operation can be controlled by driving the pressure generation device which to only raises the meniscus but not by the high electrostatic voltage.

(11) The configuration of item 11 is the liquid ejection method of any one of items (8) to 10, wherein a volume resistance of the nozzle plate is not less than $10^{15}$ Ωm.

According to the configuration of item 11, by the nozzle plate having the volume resistance of $10^{15}$ Ωm, the strong electric field can be generated at the end of the meniscus and the liquid drop let can be ejected consistently and efficiently.

(12) The configuration of item 12 is the liquid ejection method of any one of items 8 to 11, wherein a bore diameter of the ejection port is less than 15 μm.

According to the configuration of item 12, by making the inside diameter of the liquid ejection port less than 15 μm, concentration of electric field occurs efficiently, thereby the liquid droplet can be ejected consistently and efficiently.

(13) The configuration of item 13 is the liquid ejection method of any one of items 8 to 12, having a liquid ejection head and a counter electrode facing the liquid ejection head, wherein the liquid is ejected by an electrostatic attractive force created between the liquid ejection head and the counter electrode.

According to the configuration of item 13, the same effect as items 8 to 12 can be obtained in the liquid ejection method.

(14) The configuration of item 14 is the liquid ejection method of item (8), further comprising a counter electrode facing the liquid ejection head, wherein a dividing distance between the liquid ejection head and the counter electrode is controlled to be reduced by adjusting the positions thereof in polarization recovering operation.

According to the configuration of item 14, by reducing the distance between the liquid ejection head and the counter electrode, the electrostatic voltage having the reverse polarity applied in polarization recovery can be suppressed.

Effects of the Invention

According to the configuration of the item 1 or item 8, polarization of the nozzle plate can be recovered readily in the short time compared to simply ceasing application of the electrostatic voltage and waiting for polarization recovery of the nozzle plate, thereby ejection operation can be continued without deteriorating productivity due to defect of liquid ejection.

According to the configuration of the item 2 or item 9, even if the application time or the application voltage value in liquid ejection is different form those in polarization recovery, by equating the integrated values of both electrostatic voltages with respect to the application time, polarization of the nozzle plate can be recovered.

According to the configuration of the item 3 or item 10, the electrostatic voltage required for liquid droplet ejection can be reduced. Also, control of liquid ejection operation can be conducted by driving the pressure generation device.

According to the configuration of the item 4 or item 11, the liquid droplet can be ejected consistently and effectively.

According to the configuration of the item 5 or item 12, the driving voltage required for liquid ejection can be reduced.

According to the configuration of the item 6 or item 13, the same effect as that in the preceding items can be obtained.

According to the configuration of the item 7 or item 14, the electrostatic voltage value having the reverse polarity used for polarization recovery can be suppressed.

DESCRIPTION OF THE SYMBOLS

Figure 1:
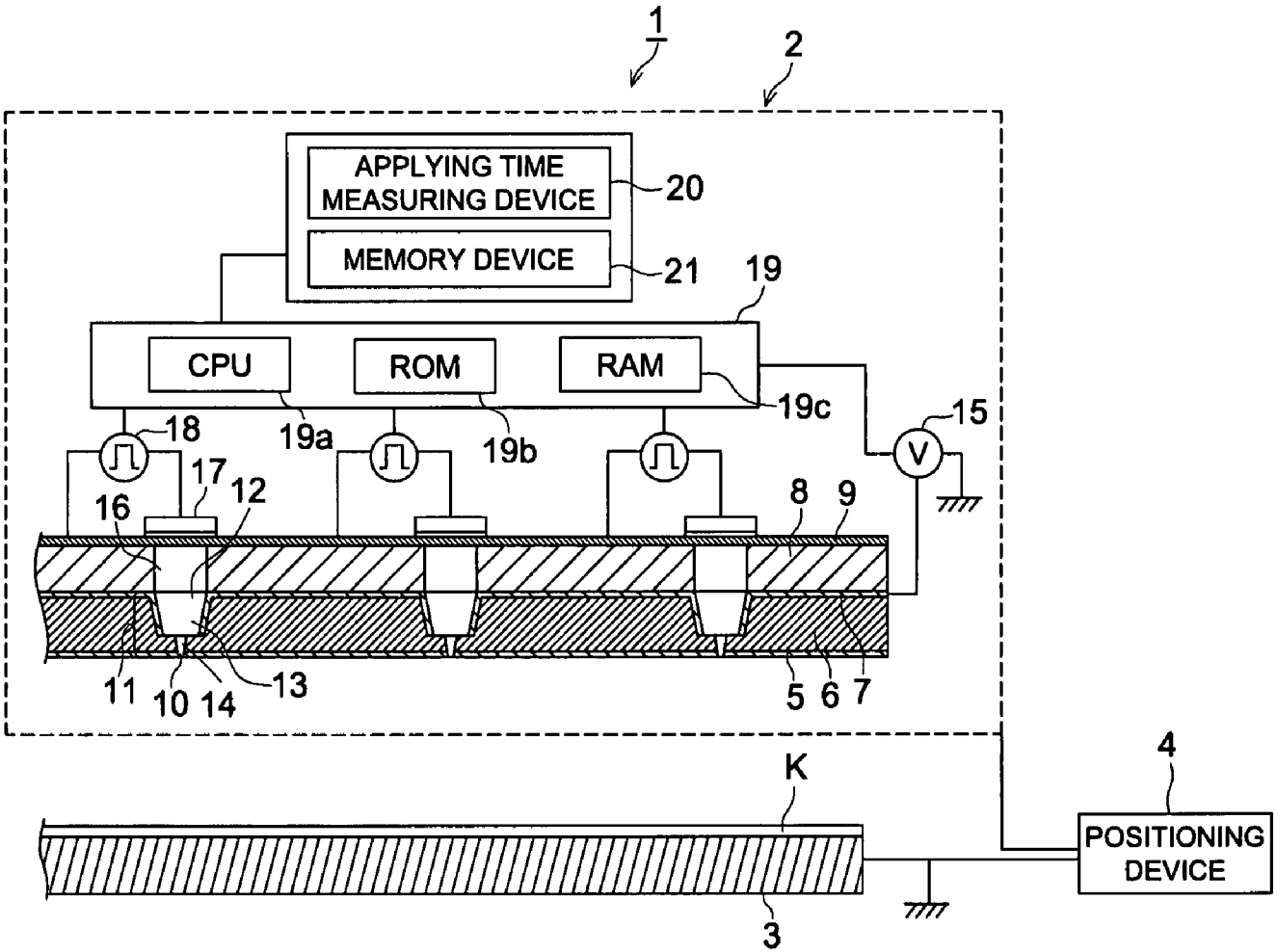
FIG. 1 is a schematic structural diagram showing a total structure of the liquid ejecting apparatus related to the first embodiment.

1 Liquid ejection apparatus
2 Liquid ejection head
3 Counter electrode
4 Positioning device
5 Ejection surface
6 Nozzle plate
7 Charging electrode
8 Body layer
9 Flexible layer
10 Ejection port
11 Nozzle
12 Liquid supply port
13 Large bore section
14 Small bore section

15 Electrostatic voltage power source
16 Cavity
17 Piezoelectric element
18 Drive voltage power source
19. Control device
20 Application time measuring device
21 Memory device
22 Head selection device
23 voltage application control device
24 Drum

PREFERRED EMBODIMENT OF THE INVENTION

First Embodiment

The first embodiment of the present invention will be described with reference to FIG. 1 to FIG. 7

FIG. 1 is a schematic cross-sectional diagram showing a total structure of a liquid ejection apparatus 1 of the present embodiment.

As FIG. 1 shows, the liquid ejection apparatus 1 is configured with a line method liquid ejection head 2 to eject a droplet of liquid such as ink capable of being charged, a counter electrode 3 facing the liquid ejection head 2 to support a substrate K which receives a droplet to land and a positioning device 4.

As FIG. 1 shows, in the liquid ejection head 2, an ejection surface 5, a nozzle plate 6, a charging electrode 7, a body layer 8 and a flexible layer 9 are arranged in laminae.

The ejection surface 5 is positioned at a side facing to the counter electrode 3 of the liquid ejection head 2 and liquid is ejected from an ejection port 10 opening on the ejection surface 5 to the substrate K supported with the counter electrode 3.

A nozzle plate 6 is configured with a silica glass on which a plurality of nozzles 11 are formed by peroration. Also, a volume resistance of the nozzle plate 6 is not less than $10^{15}$ Ωm. Thereby, a strong electric field can be obtained at a front end section of the meniscus formed at the ejection port 10.

Meanwhile, a material used for the nozzle plate 6 can be an insulation resin material without being limited to the silica glass.

Each nozzle 11 has a two step structure which includes a large bore section 13 communicating with a liquid supply port 12 to receive supply of the liquid and a small bore section 14 opening on a bottom surface of the large bore section 13 and communicating with the ejection port 10.

In the present embodiment, an opening area of the liquid supply port 12 is configured to be more than ten times as large as an opening area of the ejection port 10. Also, a length of the small bore section 14 is to be not more than 15 μm. Thus, the meniscus of the liquid can be raised in a predetermined amount, and the liquid can be ejected consistently even if the drive voltage required for ejection is reduced.

Also, each cross-sectional shape of the large bore section 13 and the small bore section 14 of the nozzle 11 has a circular form and each lateral side of the large bore section 13 and the small bore section 14 has a shape of taper towards the ejection port 10 from the liquid supply port 12 in order to reduce resistance occurs between the liquid flowing through the inside the nozzle 11 and the each lateral side. In other words, each cross-sectional area of the large bore section 13 and the small bore section 14 reduces towards the ejection port 10 from the liquid supply port 12. Meanwhile, the large bore section 13 and the small bore section 14 do not have to be formed in the taper shape.

Also, the inside diameter of the ejection port 10 to which the small bore section communicates is less than 15 μm. Thereby, the strong electric field can be obtained at the front end section of the meniscus formed at the ejection port and the liquid droplet can be ejected consistently.

Figure 2:
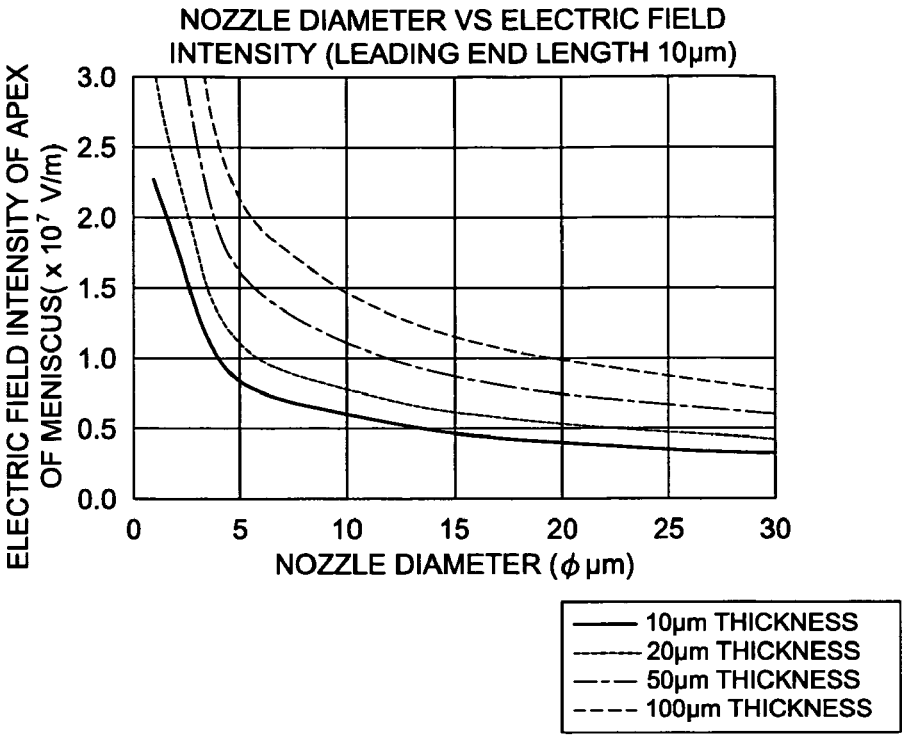
FIG. 2 is a graph showing an exemplary relation between a nozzle diameter and strength of an electric field.
Figure 3:
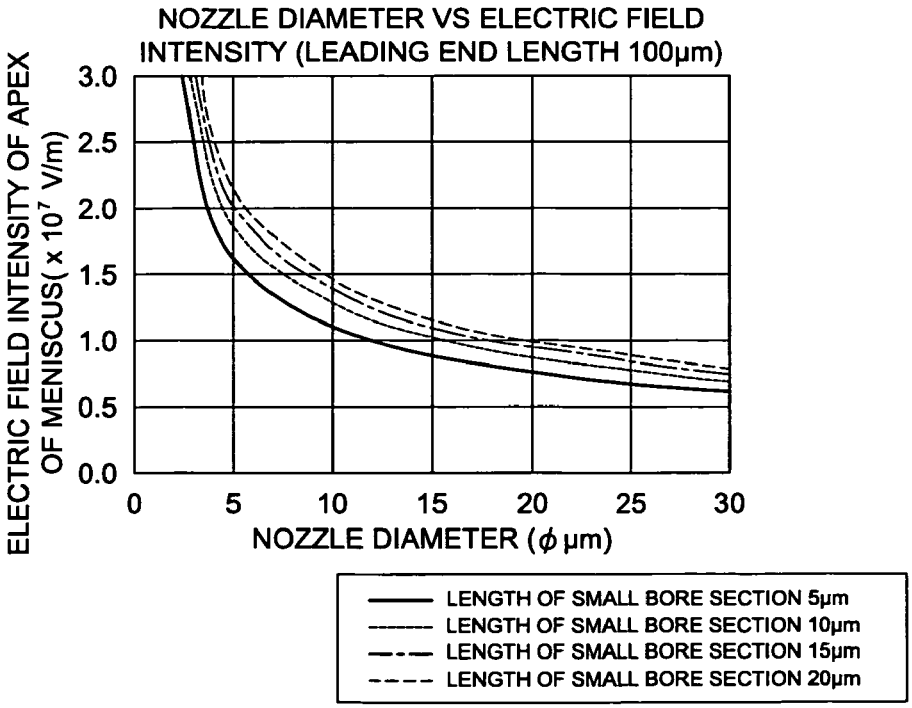
FIG. 3 is a graph showing another exemplary relation between a nozzle diameter and strength of an electric field.

The electric field intensity at the meniscus front end section with respect to the inside diameter of common ejection port is indicated in FIG. 2 and FIG. 3. FIG. 2 indicates the electric field intensity at the meniscus front end section with respect to the inside diameter of the ejection port where a thickness H of the nozzle plate 6 is 10μ to 100 μm. Also, FIG. 3 indicates the electric field intensity at the meniscus front end section with respect to the inside diameter of the ejection port where a length L of the small bore section 14 is 5 μm to 20 μm. In both cases of FIGS. 2 and 3, the intensity of the electric field increases as the inside diameter of the ejection port decreases. As above, the high intensity of the electric field can be obtained as the inside diameter decreases and the liquid droplet can be ejected consistently, therefore the smaller inside diameter of the ejection port is preferred.

The charging electrode 7 is configured with a conductive material such as Nip, and mounted on an opposite surface to ejection surface on the nozzle plate 6, and extended to an inner periphery surface of the large bore section 13 of the nozzle 11. Thereby, with a structure where the charging electrode 7 contacts with the liquid flowing inside the nozzle 11, the charging electrode 7 charges the liquid flowing inside the nozzle 11.

Also, to the charging electrode 7, an electrostatic voltage power source 15 representing an electrostatic voltage application device to apply the electrostatic voltage for creating the electrostatic attraction force is connected electrically. By applying the electrostatic voltage to the charging electrode 7 from the electro voltage power source 15, the liquid in all the nozzles 11 can be charged simultaneously since the a single charging electrode 7 is in contact with the liquid in all the nozzles. Therefore, the electrostatic attraction force is generated between the liquid ejection head 2 and the counter electrode 3 and in particular between the liquid and the substrate K.

In a body layer 8, the cavities 16 having the almost the same diameter as the liquid supply port 12 are provided respectively at a position corresponding to the liquid supply port 12 of the nozzle 11 so as to temporary reserve the liquid to be ejected.

A flexible layer 9 configured with a thin metal plate or a silicon having flexibility covers an opposite surface to the ejection surface 5 of the liquid ejection head 2 to demarcate the surface from the outside. Meanwhile, an unillustrated flow pass to supply the liquid to the cavity 16 is formed at the boundary between the body layer 8 and the flexible layer 9.

Also, at a position corresponding to the cavity 16 on an upper surface of the flexible layer 9, a piezoelectric element 17 representing a piezoelectric element actuator is provided as a pressure generating device. Meanwhile, as the pressure generating device, beside the piezoelectric element actuator of the present embodiment, an electrostatic actuator and a thermal method can be utilized.

Also, to each piezoelectric element 17, a drive voltage power source 18 to apply the drive voltage to the element and to deform the element is connected respectively.

Also, to the electrostatic voltage power source 15 and the drive voltage power source 18, the control device 19 is electrically connected, and to the control device 19, an application time measuring device 20 and a memory device 21 are electrically connected.

Next, the counter electrode 3 is a counter electrode in a shape of flat plate to support the substrate K, and disposed blow the liquid ejection head in parallel with and being separated from the ejection surface 5 of the ejection head 2, with a predetermined dividing distance.

The counter electrode 3 is connected to the ground and is always maintained at a ground voltage level. Therefore, when the electrostatic voltage is applied to the charging electrode 7 from the electrostatic voltage power source 15, the electric field is created between the liquid in the ejection port 10 and an opposing surface of the counter electrode 3 facing the liquid ejection head 2.

The positioning device 4 is connected to the liquid ejection head 2 and the counter electrode 3.

Next, a control configuration of the liquid ejection head 2 of the present embodiment will be described.

The electrostatic voltage power source 15 applies the electrostatic voltage onto the charging electrode 7 when ejecting the liquid. Thereby, the liquid in all the nozzles 11 is charged simultaneously, and an electrostatic attraction force is created between the liquid ejection head 2 and the counter electrode 3, and in particular between the liquid and the substrate K.

Meanwhile, the electrostatic power source 15 can be a configuration where a discretional wave shape can be applied synchronously with a timing of liquid ejection, beside the configuration where a constant voltage is constantly applied while the liquid ejection head is in a state where ejection is possible.

The drive electric voltage power source 18 deforms the piezoelectric element 17 by applying the drive voltage to each piezoelectric element 17 in liquid ejection, generates a pressure in the liquid inside the nozzle 11 and forms the meniscus projecting in the ejection direction of the liquid at the ejection port 10. Thereby an extremely strong electric field concentration occurs at the meniscus front end section. Thus the meniscus is torn off by the electrostatic force of the electric field and separated from the liquid inside the nozzle 11 to be a liquid droplet. Further, the liquid droplet is accelerated by the electro static force and attracted to the substrate K supported by the counter electrode 3 then lands on the substrate K. When this occurs, since the liquid droplet tends to fly perpendicular to the substrate K with an effect of the electrostatic force, flaying direction becomes steady and an accuracy of landing position is enhanced.

The application time measuring device 20 measures the application time of the electrostatic voltage applied to the charging electrode 7 in the liquid ejection head 2 and stores a measurement result in the memory device 21.

The memory device 21 is configured with a rewritable nonvolatile recording medium such as flash memory and stores electrostatic voltage data in liquid ejection. Here, the electrostatic voltage data in liquid ejection means an electrostatic voltage application time $t_1$ where the electrostatic voltage power source 15 applies the electrostatic voltage onto the charging electrode 7 in liquid ejection and an electrostatic voltage value $V_1$.

The control device 19 is configured with an unillustrated CPU 19*a*, a ROM 19*b* and a RAM 19*c*. The CPU 19*a* executes a program stored in the ROM 19*b* to drive the drive voltage power source 18 and the electrostatic voltage power source 15, so that the liquid ejection head 2 carries out liquid ejection operation.

Also, the controls device 19 operates the electrostatic voltage power source 15 to conduct polarization relaxation operation where the electrostatic voltage having the reverse polarity opposite to the electrostatic voltage applied in liquid ejection is applied. Thus, the electrostatic voltage power source 15 applies the electrostatic voltage onto the charging electrode 7 for a predetermined time at a predetermined voltage value, thereafter applies the electrostatic voltage having the reverse polarity to that in liquid ejection for a predetermined at a predetermined voltage value so as to recover polarization of the nozzle plate 6. Meanwhile, the electrostatic voltage value in liquid ejection and the electrostatic voltage value having the reverse polarity have to be not more than a dielectric breakdown voltage value.

Figure 4:
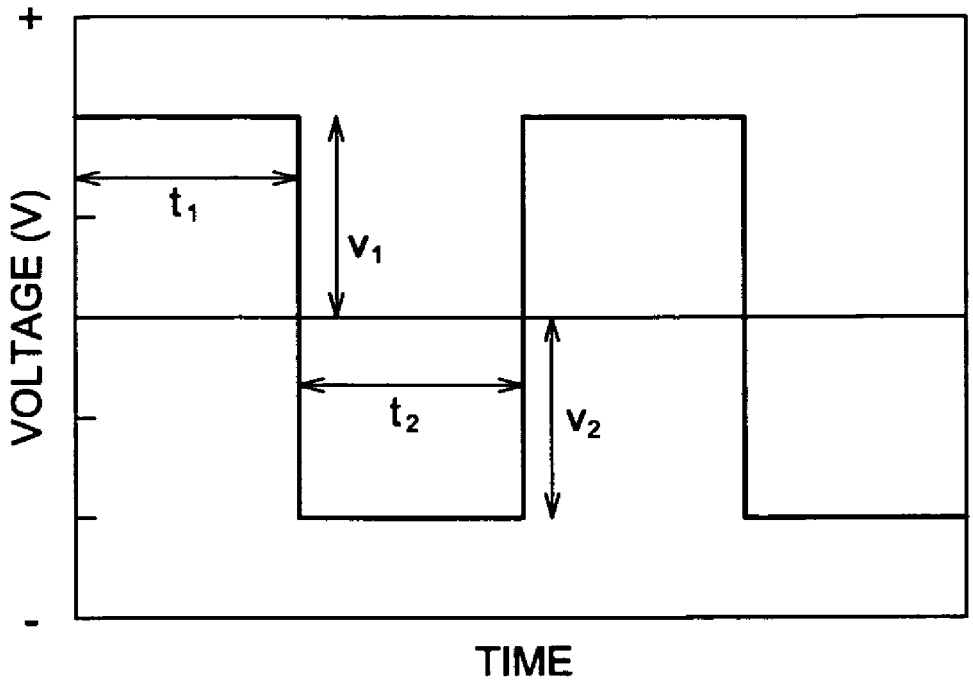
FIG. 4 is a graph showing an exemplary electrostatic voltage applied to the liquid ejection head related to the first embodiment.

FIG. 4 shows the electrostatic voltage applied from the electrostatic voltage power source 15. In the present embodiment, as FIG. 4 shows, $v_1$ denotes the electrostatic voltage value in liquid ejection, $t_1$ denotes application time in liquid ejection, $v_2$ denotes electrostatic voltage value in polarization recovery and $t_2$ denote application time in polarization recovery, and the electrostatic voltage value $v_2$ is determined so that the application time $t_1$ equates to the application time $t_2$, an absolute value of the electrostatic voltage value $v_1$ equates to an absolute value of the electrostatic voltage value $v_2$, thereafter the electrostatic voltage having the reverse polarity is applied in polarization recovery.

Also, the application time $t_1$ in liquid ejection is a time till the consistent liquid ejection becomes impossible due to deterioration of the electric field intensity at the front end section of the meniscus due to polarization of the nozzle plate 6 caused by applying the electrostatic voltage continuously through the electrostatic voltage power source 15.

Figure 5:
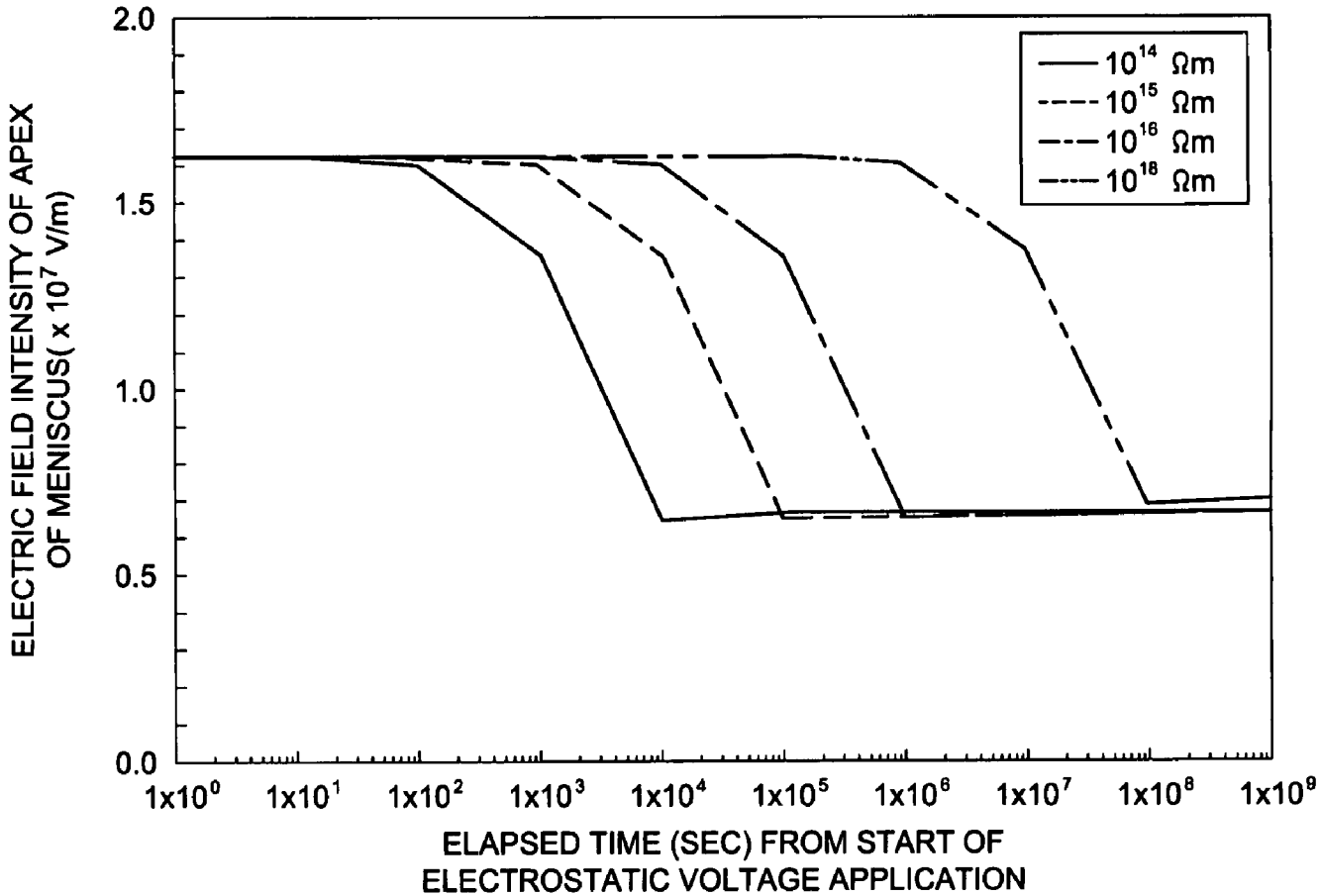
FIG. 5 is a graph showing change of strength of an electrostatic field at an end of a meniscus with respect to electrostatic voltage application time.

FIG. 5 shows a change of the electric filed intensity at the front end section of the meniscus with respect to the electrostatic voltage application time. As FIG. 5 shows, by applying the electrostatic voltage onto the charging electrode 7 for a predetermined time continuously, the nozzle plate 6 is polarized and the electric field intensity at the front end section of the meniscus starts to deteriorate. Meanwhile, the time until the electric field intensity starts to deteriorate differs with the volume resistance of the nozzle plate 6 and the higher volume resistance can maintain a state of the strong electric field intensity longer. Therefore, the material having a higher volume resistance is preferred to be used for the nozzle plate 6.

As above, by continuing liquid ejection operation while applying the electrostatic voltage between the nozzle plate 6 and the counter electrode 3, the electric field intensity is deteriorated due to polarization of the nozzle plate 6 and a liquid ejection state is changed. Therefore the control device 19 causes the electrostatic voltage power source 15 to carry out polarization relaxation operation so as to prevent the liquid ejection state from changing due to deterioration of the electric field intensity.

Figure 6:
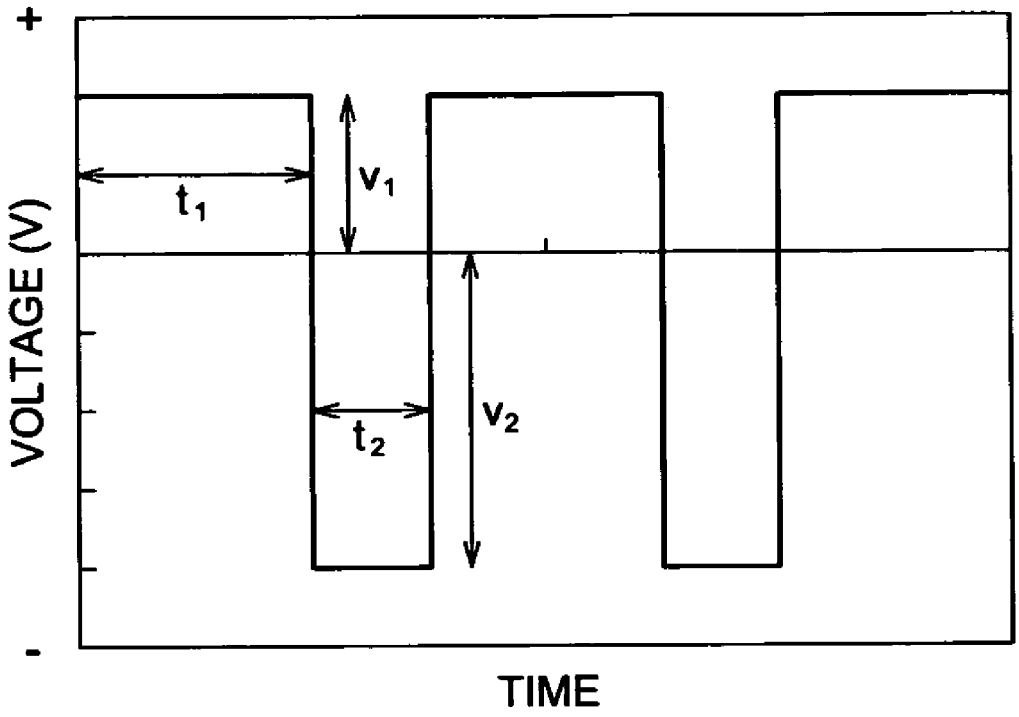
FIG. 6 is a graph showing another exemplary electrostatic voltage applied to a liquid ejection head related to the present embodiment.

Next, another electrostatic voltage application pattern onto the charging electrode 7 is shown in FIG. 6. In the example in FIG. 6, the electrostatic voltage having the reverse polarity is applied in polarization recovery upon determination of the electrostatic voltage value $v_2$ in a way that an integrated value of the electrostatic voltage $v_1$ with respect to the application time $t_1$ equates to an integrated value of the electrostatic voltage $v_2$ with respect to the application time $t_2$, namely the equation that $|\text{application time } t_1 \times \text{electrostatic voltage } v_1| = |\text{application time } t_2 \times \text{electrostatic voltage } v_2|$ is satisfied.

As above, by applying the electrostatic voltage having the same value and reverse polarity opposite to that of the electrostatic voltage applied in liquid ejection, the polarization of the nozzle plate 6 can be recovered.

Further, in case a gap between the liquid ejection head 2 and the counter electrode 3 is changed in liquid ejection and in polarization recovery, the electrostatic voltage having the reverse polarity is applied in accordance with the gap. Namely, the electrostatic voltage having reverse polarity is applied in a way that a value of multiplying an absolute value of integrated value of electrostatic voltage value with respect to the time by an inverse number of the gap in liquid ejection equates to a value thereof in polarization recovery.

For example, being given that the gap between the liquid ejection head 2 and the counter electrode 3 at liquid ejection is ½, the electrostatic voltage having the reverse polarity can be ½. Therefore, the electrostatic voltage value $v_2$ having reverse polarity which satisfies an equation that |application time $t_1$×electrostatic voltage $v_1$|=|application time $t_2$×electrostatic voltage $v_2$| is applied.

The positioning device 4 causes the liquid droplet ejected from each nozzle 11 of the liquid ejection head 2 to land at a selected position on the surface of the substrate K by relatively moving the liquid ejection head 2 and the substrate K supported through the counter electrode 3.

Also, the positioning device 4 appropriately sets the deviation distance (gap) between the counter electrode 3 and the liquid ejection head 2 within a range of 0.1 mm to 3.0 mm. Thereby when the electrostatic voltage power source 15 applies the electrostatic voltage having the reverse polarity opposite to that in liquid ejection, the gap between the counter electrode 3 and the liquid ejection head 2 is reduced. For example, being given that the gap between the liquid head 2 and the counter electrode 3 at polarization recovery is about ½, an effect that the electrostatic voltage value applied in polarization recovery can be ½ is obtained.

Figure 7:
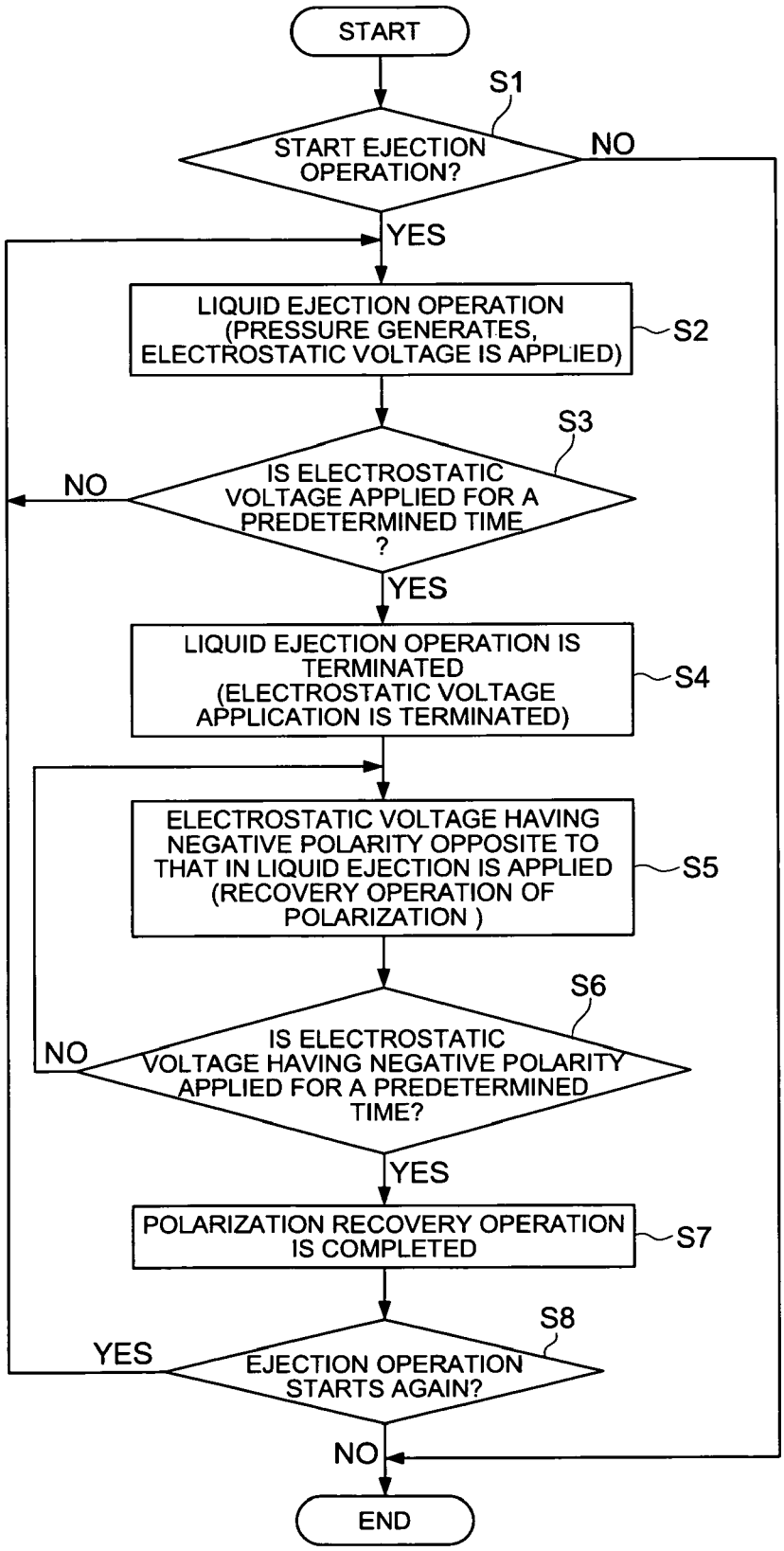
FIG. 7 is a flow chart indicating a liquid ejection method related to the first embodiment.

Next, a liquid ejection method using the liquid ejection head 2 of the present invention will be described with reference to a flow chart in FIG. 7.

When a command signal of liquid ejection operation is inputted from an unillustrated device, the control device 19 decides whether or not the ejection of the liquid starts (Step S1), and if "not start" is decided, the process is terminated.

On the other hand, if "start" is decided, the control device 19 controls the electrostatic voltage power source 15 to apply the electrostatic voltage to the charging electrode 7. Thereby the liquid inside all the nozzles 11 is charged simultaneously and the electrostatic attraction force is generated between the liquid and the substrate K.

Subsequently, the control device 19 controls the drive voltage power source 18 so as to deform the piezoelectric element 17 by applying the drive voltage to each piezoelectric element 17 and create a pressure in the liquid inside the nozzle 11. Thereby a meniscus projecting towards the ejection direction is formed at the ejection port 10 of the liquid. Then, a strong electric field concentration occurs at a front end section of the meniscus and the meniscus is torn off by the electrostatic force of the electric field, then the meniscus is separated from the liquid inside the nozzles 11 to be a liquid droplet. Further, the liquid droplet is accelerated by the electrostatic force and attracted to the substrate K supported by the counter electrode 3 and then lands thereon (Step S2).

On the other hands, the memory device 21 stores the electrostatic voltage application time $t_1$ and the electrostatic voltage value $v_1$.

Subsequently, the control device 19 judges whether or not the electrostatic voltage application time $t_1$ has elapsed since start of application of the electrostatic voltage (Step S3), and if not yet elapsed, the control device 19 causes the electrostatic power source 15 to continue ejection of the liquid (Step S2), then if elapsed already, the control device 19 causes the electrostatic power source 15 to stop application of the electrostatic voltage $v_1$ to terminate liquid ejection operation (Step S4).

Meanwhile, after termination of liquid ejection operation, and before application the electrostatic voltage having reverse polarity, the positioning device 4 may narrow the dividing distance (gap) between the counter electrode 3 and the liquid ejection head 2.

Next, the control device 19 determines the polarization recovery time $t_1$ and the electrostatic voltage value $v_2$ to recover polarization of the nozzle plate 6, based on the electrostatic application time $t_1$ and the electrostatic voltage value $v_1$ stored in the memory device 21.

For example, as an example in FIG. 4 indicates, the electrostatic voltage value $v_2$ having reverse polarity is determined so that equations that electrostatic voltage application time $t_1$=polarization recovery time $t_2$, and |electrostatic voltage value $v_1$|=|electrostatic voltage value $v_2$| are satisfied. Also as an example in FIG. 6 indicates, the electrostatic voltage value $v_2$ having the reverse polarity can be determined so that an equation that |electrostatic voltage application time $t_1$×electrostatic voltage value $v_1$|=|polarization recovery time $t_2$×electrostatic voltage value $v_2$| is satisfied. As above, polarization of the nozzle plate 6 can be recovered by applying electrostatic voltage $v_2$ in a way that an integrated value of the electrostatic voltage value $v_1$ with respect to the electrostatic voltage application time $t_1$ equates with an integrated value of the electrostatic voltage value $v_2$ with respect to the electrostatic voltage application time $t_2$.

Also, in case the gap between the liquid ejection head 2 and the counter electrode 3 in liquid ejection has been changed in polarization recovery, the control device 19 applies the electrostatic voltage having the reverse voltage polarity in accordance with the gap. Namely, the electric voltage having reverse polarity is applied in the way that the absolute value of multiplying the integrated value of the electrostatic voltage value with respect to the application time by the reverse number of the gap in liquid ejection equates to the absolute value thereof in polarization recovery.

Next, the control device 19 controls the electrostatic voltage power source 15 to apply the electrostatic voltage $v_2$ having the reverse polarity (Step S5) to the charging electrode 7. Subsequently, the Control device 15 judges whether or not the electrostatic voltage application time $t_2$ has been elapsed since start of applying the electrostatic voltage having the reverse voltage polarity (step S6), and if not yet elapsed, the polarization relaxation operation is continued (Step S5) and if elapsed already, polarization relaxation operation is terminated (Step S7).

Next, the control device 19 determines whether or not liquid ejection is continued (Step S8), and if continued, the liquid is ejected by applying the electrostatic voltage again (Step S2). Contrarily, if not continued, the process is terminated.

As above, according to the liquid ejection head 2, liquid ejection apparatus 1 and liquid ejection method related to the present embodiment, when ejection of liquid becomes impossible after liquid ejection operation is continued for a long time by applying an electrostatic voltage having the same polarity between the counter electrode 3 and the flat nozzle plate 6 having insulation properties, polarization of the nozzle plate 6 can be recovered by applying the electrostatic voltage having a reverse polarity opposite to that of the electrostatic voltage applied in liquid ejection. Thereby, the nozzle plate 6 can be recovered readily in a short time, compare to just waiting recovery of polarization of the nozzle plate by simple ceasing application of electrostatic voltage. Therefore, in case the liquid ejection head 2 is used for a production line, ejection operation can be continued without deteriorating the productivity due to defect ejection of liquid.

Also, polarization of the nozzle plate can be recovered by applying the reverse voltage so that the integrated values of the electrostatic voltage applied in liquid ejection and in the polarization relaxation operation with respect to the application time equate. Therefore, for example, if the polarization relaxation operation time is desired to be shortened, polarization of the nozzle plate caused by applying the electrostatic voltage in liquid ejection can be recovered by increasing the electrostatic voltage value.

Also, by forming the meniscus through the pressure generating device, the electro static voltage required for ejecting the liquid droplet can be reduced. Also, control of liquid ejection operation can be conducted by driving the pressure generation device which only raises the meniscus but not by the electrostatic voltage having a high voltage.

Also, by employing the nozzle plate 6 having a volume resistance of not less than $10^{15}$ Ωm, a strong electric field can be created at the front end of the meniscus and the liquid droplet can be ejected consistently and efficiently.

Also, by making the inside diameter of the ejection port less than 15 μm, the electric field at the front end of the meniscus can be concentrated effectively, thus the liquid droplet can be ejected consistently and efficiently.

Also, the electrostatic voltage value having a reverse polarity used for polarization recovery can be suppressed by narrowing the dividing distance between the liquid ejection head and the counter electrode.

Second Embodiment

Next a second embodiment of the present invention will be described with reference to FIG. 8 to FIG. 11. Meanwhile, the same components as that in the above embodiment are denoted by the same symbols and descriptions thereof are omitted.

Figure 8:
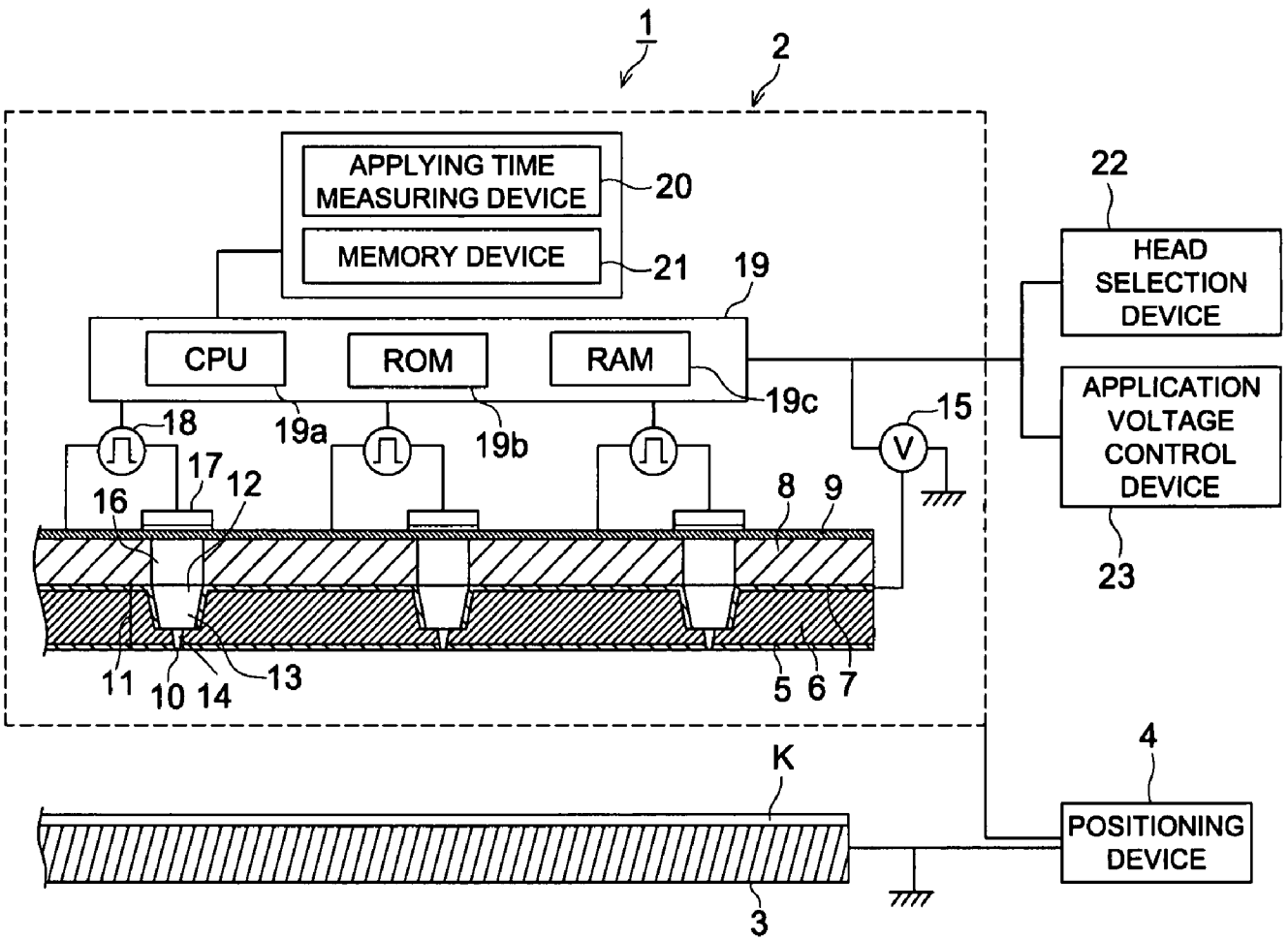
FIG. 8 is a schematic structural diagram showing a total structure of a liquid ejection apparatus related to a second embodiment

The liquid ejection apparatus 1 of the present embodiment is equipped with a plurality of the liquid ejection heads. Also, as FIG. 8 shows, to the liquid ejection head 2 of the present embodiment, a head selecting device 22 and a voltage application control device 23 representing a changeover device is connected electrically.

Figure 9:
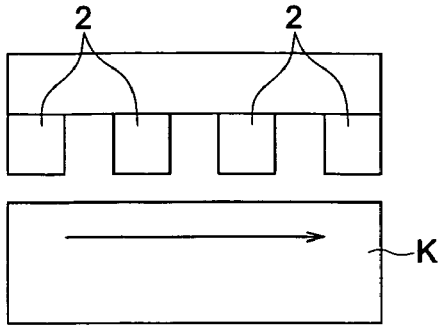
FIG. 9 is a front view showing an exemplary layout of a liquid ejection head related to a second embodiment.

Next, an allocation of the plurality of the liquid ejection heads 2 will be described. As FIG. 9 shows, in a liquid ejection apparatus 1, line method liquid ejection heads 2 disposed along a direction perpendicular to a conveyance direction of the substrate K are allocated in four lines parallel. Meanwhile, the liquid ejection head of the present invention can be allocated not limited to in four lines, but the head can be allocated parallel in a plurality of lines.

Figure 10:
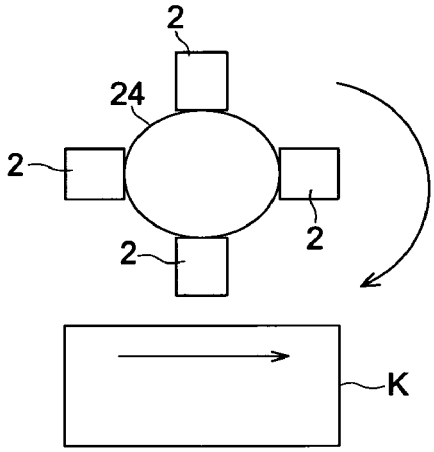
FIG. 10 is a front view showing another exemplary layout of a liquid ejection head related to a second embodiment.
Figure 11:
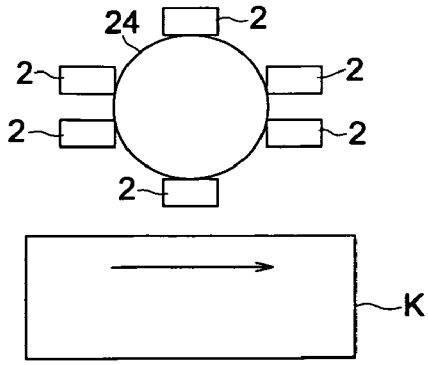
FIG. 11 is a front view showing yet another exemplary layout of a liquid ejection head related to a second embodiment.

Meanwhile, as an allocation of the plurality of the liquid ejection heads 2, as FIG. 10 shows, the heads can be mounted at equal interval on an outer periphery of a drum 24 having an unillustrated rotation mechanism. Also, As FIG. 11 shows, each of the plurality of the liquid ejection heads 2 can be mounted rotatabley on the outer periphery of the drum 24. In this case, to eject the liquid from a predetermined liquid head, an unillustrated head moving device drives the unillustrated rotation mechanism to rotate the drum 24 in a way that an ejection surface of the liquid ejection head 2 thereof faces the substrate K side.

Next, a control configuration of the liquid ejection apparatus will be described.

The head selecting device 22 is configured with an unillustrated CPU, ROM and RAM. The CPU executes a program stored in the ROM to select the liquid ejection head 2 for starting the liquid ejection operation and outputs a result of selection to the voltage applying control device 23.

Namely, based on the measurement result of the application time measuring device 20, when the application time of the electrostatic voltage applied onto the liquid ejection head 2 to eject the liquid reaches to the electrostatic voltage application time $t_1$, the head selection device 22 selects another liquid ejection head 2 among the liquid ejection heads 2 in four lines.

The voltage application control device 23 is configured with an unillustrated CPU, ROM and RAM. The CPU executes a program in the ROM to control the control device 19 equipped in each liquid ejection head 2 and controls liquid ejection with respect to each liquid ejection head 2.

Namely, the voltage application control device 23 conducts a function of the changeover device. When the head selection device 22 selects the liquid ejection head 2 to start liquid ejection operation, changing is carried out so that the electrostatic voltage is applied to the selected liquid ejection head 2.

Next, different portions of liquid ejection method of the present invention using the liquid head 2 from the above embodiment will be described.

When the liquid ejection process starts, the voltage application control device 23 sends a command signal to start the liquid ejection operation to a control device 19 of any one of the liquid ejection heads 2 among four lines.

Subsequently, when the liquid ejection operation starts in the predetermined liquid ejection head 2, the application time measuring device 20 measures the electrostatic voltage application time and stores the measurement result in the memory device 21 and then outputs the result thereof to the head selection device 22. Also, the memory device 21 stores the electrostatic voltage value of the electrostatic voltage power source 15.

Next, when the application time of the electrostatic voltage in liquid ejection reaches to the electrostatic voltage application time $t_1$, the voltage application control device 23 terminates the liquid ejection operation of the liquid ejection head 2. Also, the head selecting device 22 selects another liquid ejection head 2 among the liquid ejection heads 2 in four lines and outputs the result of selection to the voltage application control device 23.

Subsequently, the voltage application control device 23 sends a command signal of starting liquid ejection operation to the control device 19 of the liquid ejection head 2 selected by the head selecting device 22.

On the other hand, the voltage application control device 23 sends a command signal of starting polarization relaxation operation to the control device 19 of the liquid ejection head 2 which has completed liquid ejection operation.

Subsequently, the control device 19 of the liquid ejection head 2, which has received the command signal to start polarization recovery, applies the electrostatic voltage having the reverse polarity opposite to that of liquid ejection by control of the electrostatic voltage power source 15 to recover polarization of the nozzle plate 6.

As above, according to the liquid ejection head 2, the liquid ejection apparatus 1 and the liquid ejection method of the present embodiment, in the liquid ejection apparatus 1 provided with the plurality of the liquid ejection head 2, while one liquid ejection head 2 performing liquid ejection operation, polarization relaxation operation of other liquid ejection heads 2 which has completed liquid ejection can be carried out. Thereby, as a whole, while carrying out polarization relaxation operation, liquid ejection operation of the liquid ejection apparatus 1 can be continued.

As specifically described in the forgoing, according to the liquid ejection head, the liquid ejection apparatus and the liquid ejection method of the present invention, by recovering the polarization state of the nozzle plate readily in a short time, the ejection operation can be continued without deteriorating productivity due to defect of liquid ejection even in case the liquid ejection head is used in a production line. Meanwhile, the embodiments where the electrostatic voltage is applied to the liquid in the liquid ejection head and the counter electrode is grounded have been described. Contrarily, an embodiment where the electrostatic voltage is applied on the counter electrode and liquid ejection head is grounded can be utilized to obtain the same effect.

What is claimed is:

1. A liquid ejection apparatus, comprising a liquid ejection head having:

an insulating nozzle plate provided with a nozzle having, a liquid supply port to supple liquid and an ejection port to eject the liquid supplied from the liquid supply port onto a substrate, a cavity communicating with the liquid supply port to reserve the liquid to be ejected from the ejection port, an electrostactic voltage applying device to generate an electrostatic attraction force by applying an electrostatic voltage, and a control device to control the electrostatic voltage applying device, so that the electrostatic voltage is applied in liquid ejection and an electrostatic voltage having reverse polarity opposite to that of the electrostatic voltage applied in liquid ejection is applied in polarization relaxation operation, and a counter electrode facing the liquid ejection head to attract the liquid by the electrostatic attraction force generated between the liquid ejection head and the counter electrode, and a positioning device to adjust the positions of the liquid ejection head and the counter electrode so that a dividing distance between the liquid ejection head and the counter electrode decreases in the polarization relaxation operation, and controlling the electrostatic voltage applying device to conduct the polarization relaxation operation in which the electrostatic voltage having reverse polarity opposite to that of the electrostatic voltage applied in liquid ejection is applied, wherein the nozzle is a flat nozzle not protruding from the nozzle plate and the electrostatic voltage is applied between the liquid in the nozzle and the cavity, and the counter electrode.

2. The liquid ejection apparatus of claim 1, further comprising:

a memory device to store an application time and an application voltage value of an electrostatic voltage applied by the electrostatic voltage applying device in liquid ejection, wherein based on the application time and the application voltage value, the control device determines the electrostatic voltage value having reverse polarity so that an absolute value of an integrated value of the electrostatic voltage value applied in liquid ejection with respect to the application time multiplied by a ratio of dividing distance in the polarization operation to that in liquid ejection and an absolute value of an integrated value of the electrostatic voltage value having reverse polarity with respect to the application time in the polarization relaxation operation equate, and causes the electrostatic voltage applying device to conduct polarization relaxation operation using the electrostatic voltage value thereof.

3. The liquid ejection apparatus of claim 1, further comprising a pressure generation device to generate a pressure in the liquid by changing a volume of the cavity for forming a meniscus projecting towards and ejection direction of the liquid at the ejection port.

4. The liquid ejection apparatus of claim 1, wherein a volume resistance of the nozzle plate is not less than $10^{15}$ Ωm.

5. The liquid ejection apparatus of claim 1, wherein an inside diameter of the ejection port is less than 15 μm.

6. A liquid ejection method, comprising the steps of;

using a liquid ejection head having:

an insulating nozzle plate provided with a nozzle having a liquid supply port to supply liquid and an ejection port to eject the liquid supplied from the liquid supply port onto a substrate, a cavity communicating with the liquid supply port to reserve the liquid to be ejected from the ejection port, an electrostatic voltage applying device to generate an electrostatic attractive force by applying and electrostatic voltage, a control device to control application of the electrostatic voltage by the electrostatic voltage applying device, a counter electrode facing the liquid ejection head for attracting the liquid by the electrostatic attraction force generated between the liquid ejection head and the counter electrode; and adjusting the positions of the liquid ejection head and the counter electrode with a positioning device , so that a dividing distance between the liquid ejection head and the counter electrode decreased in polarization relaxation operation, and controlling the electrostatic voltage applying device to conduct the polarization relaxation operation in which the electrostatic voltage having reverse polarity opposite to that of the electrostatic voltage applied in liquid ejection is applied wherein the nozzle is a flat nozzle not protruding from the nozzle plate and the electrostatic voltage is applied between the liquid in the nozzle and cavity, and the counter electrode.

7. The liquid ejection method of claim 6, comprising:

using a memory device to store the application time and the application voltage value of the electrostatic voltage applied by the electro static voltage application device in liquid ejection;

determining the electrostatic voltage value having reverse polarity based on the application time and the application voltage value so that an absolute value of an integrated value of the electrostatic voltage value applied in liquid ejection with respect to the application time multiplied by a ratio of the dividing distance in the polarization relaxation operation to that in liquid ejection and an absolute value of an integrated value of the electrostatic voltage value having reverse polarity with respect to the application time in the polarization relaxation operation equate; and causing the electrostatic voltage applying device to conduct polarization relaxation operation using the electrostatic voltage value.

8. The liquid ejection method of claim 6, comprising:

generating a pressure in the liquid by changing a volume of the cavity; and ejecting the liquid using the pressure generating device to form a meniscus projecting towards a liquid ejection direction at the ejection port.

9. The liquid ejection method of claim 6, wherein a volume resistance of the nozzle plate is not less than $10^{15}$ Ωm.

10. the liquid ejection method of claim 6, wherein an inside diameter of the ejection port is less than 15 μm.

* * * * *